US011584972B2

(12) United States Patent
Winkel et al.

(10) Patent No.: US 11,584,972 B2
(45) Date of Patent: Feb. 21, 2023

(54) METHOD FOR HEATING A METAL COMPONENT TO A TARGET TEMPERATURE AND CORRESPONDING ROLLER HEARTH FURNACE

(71) Applicant: Schwartz GmbH, Simmerath (DE)

(72) Inventors: Jörg Winkel, Nideggen-Schmidt (DE); Andreas Reinartz, Monschau (DE); Frank Wilden, Simmerath (DE)

(73) Assignee: Schwartz GmbH, Simmerath (DE)

( * ) Notice: Subject to any disclaimer, the term of this patent is extended or adjusted under 35 U.S.C. 154(b) by 184 days.

(21) Appl. No.: 16/642,404

(22) PCT Filed: Aug. 31, 2018

(86) PCT No.: PCT/EP2018/073474

§ 371 (c)(1),
(2) Date: Feb. 27, 2020

(87) PCT Pub. No.: WO2019/043161

PCT Pub. Date: Mar. 7, 2019

(65) Prior Publication Data

US 2021/0155996 A1 May 27, 2021

(30) Foreign Application Priority Data

Sep. 1, 2017 (DE) ..... 10 2017 120 128.9

(51) Int. Cl.
*C21D 9/00* (2006.01)
*F27B 9/10* (2006.01)
*F27B 9/24* (2006.01)

(52) U.S. Cl.
CPC ..... *C21D 9/0056* (2013.01); *C21D 9/0062* (2013.01); *F27B 9/10* (2013.01); *F27B 9/2407* (2013.01)

(58) Field of Classification Search
None
See application file for complete search history.

(56) References Cited

U.S. PATENT DOCUMENTS 4,753,421 A 6/1988 Makibayashi et al.
5,147,083 A * 9/1992 Halstead ..... B23K 1/0012 228/42

(Continued)

FOREIGN PATENT DOCUMENTS

AU 2005330295 B2 * 3/2011 ..... F27D 3/12
DE 102009050879 B3 9/2011

(Continued)

OTHER PUBLICATIONS

Heraeus, Properties of Fused Silica (Year: 2016).*

(Continued)

*Primary Examiner* — Steven S Anderson, II
*Assistant Examiner* — Kurt J Wolford
(74) *Attorney, Agent, or Firm* — Occhiuti & Rohlicek LLP

(57) ABSTRACT

The method for heating a metal component to a target temperature, in which the component has a preliminary coating and is passed through a furnace that has at least four zones, which can be respectively adjusted to an individual zone temperature, wherein the component is passed successively through at least an initial heating zone, a plateau zone, a peak heating zone and an end zone and wherein the initial heating zone is adjusted to an initial heating temperature, the plateau zone is adjusted to a plateau temperature, the peak heating zone is adjusted to a peak temperature and the end zone is adjusted to the target temperature, the plateau temperature being chosen such that the temperature of the component in the plateau zone lies in a band around a melting temperature of the preliminary coating which is (Continued)

Figure 1:
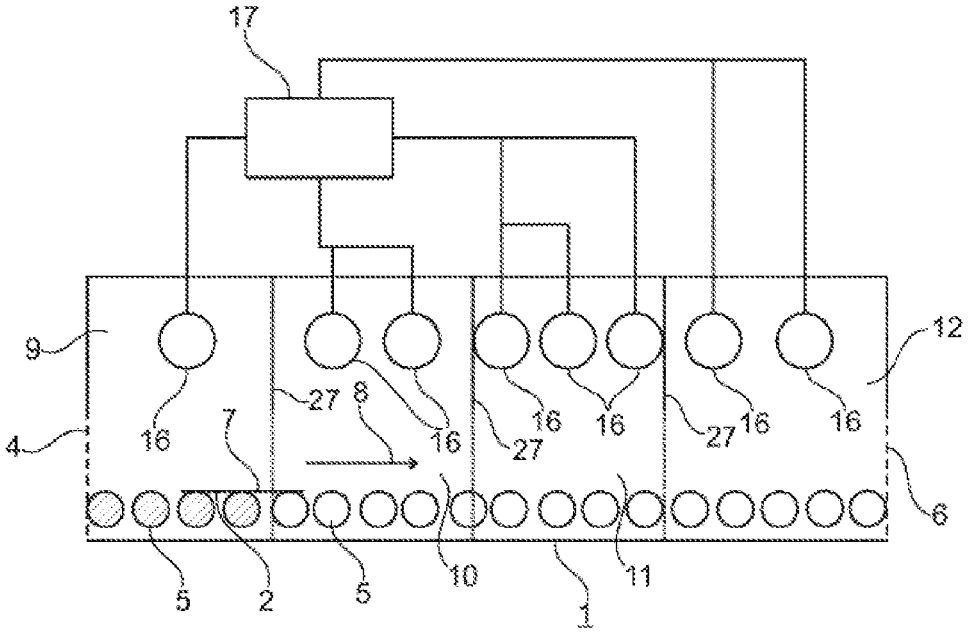

characterized in that the peak temperature lies by at least 100 K above the target temperature.

12 Claims, 3 Drawing Sheets

(56) References Cited

U.S. PATENT DOCUMENTS

| | | | |
|---|---|---|---|
| 9,631,248 | B2 | 4/2017 | Hwang et al. |
| 2010/0086002 | A1 | 4/2010 | Hwang et al. |

FOREIGN PATENT DOCUMENTS

| | | | | | |
|---|---|---|---|---|---|
| DE | 102010017905 | A1 | * | 10/2011 | ..... C21D 1/42 |
| DE | 102012221120 | A1 | | 5/2014 | |
| DE | 102013107870 | A1 | | 1/2015 | |
| DE | 102013015347 | A1 | * | 3/2015 | ..... F27B 9/2407 |
| DE | 202014010318 | U1 | | 4/2015 | |
| DE | 202012013282 | U1 | | 11/2015 | |
| DE | 102014110415 | A1 | * | 1/2016 | ..... C21D 1/673 |
| DE | 102014110415 | A1 | | 1/2016 | |
| DE | 102016100648 | A1 | | 6/2017 | |
| EP | 2497840 | A1 | * | 9/2012 | ..... C21D 9/0062 |
| EP | 3144620 | A1 | | 3/2017 | |
| JP | S629039 | A | | 1/1987 | |
| JP | S62184250 | A | | 8/1987 | |
| WO | 2013/000001 | A1 | | 1/2013 | |
| WO | WO-2014076266 | A1 | * | 5/2014 | ..... C22C 38/00 |
| WO | WO-2015110456 | A1 | * | 7/2015 | ..... F27B 9/06 |
| WO | 2015139857 | A1 | | 9/2015 | |
| WO | WO-2016001701 | A1 | * | 1/2016 | ..... C23C 2/40 |
| WO | WO-2017129600 | A1 | * | 8/2017 | ..... C21D 1/667 |

OTHER PUBLICATIONS

DE_102010017905_A1 English translation (Year: 2011).*
DE_102013015347_A1 English translation (Year: 2015).*
DE_102014110415_A1 English translation (Year: 2016).*
EP_2497840_A1 English translation (Year: 2012).*
WO_2014076266_A1 English translation (Year: 2014).*
WO_2015110456_A1 English translation (Year: 2015).*
WO_2017129600_A1 English translation (Year: 2017).*
Chinese Office Action dated Mar. 2, 2021 in CN Application No. 2018800568976.

* cited by examiner

METHOD FOR HEATING A METAL COMPONENT TO A TARGET TEMPERATURE AND CORRESPONDING ROLLER HEARTH FURNACE

CROSS REFERENCE TO RELATED APPLICATIONS

This application is a National Phase under 35 U.S.C. 371 of International Application No. PCT/EP2018/073474 filed on Aug. 31, 2018, which claims priority to German Application No. 10 2017 120 128.9 filed Sep. 1, 2017, the contents of which are hereby incorporated by reference in their entirety.

The present invention relates to a method for heating a preliminarily coated metal component in a roller hearth furnace and a corresponding roller hearth furnace. The method according to the invention can be used in particular in a press hardening line in which a press hardening tool is arranged downstream of a roller hearth furnace.

For the manufacture of safety-related vehicle body parts made of sheet metal, it is usually necessary to harden the metal sheet during or after the forming of the body part. For this purpose, a heat treatment method has been established, which is referred to as "press-hardening." In this case, the steel sheet, which is typically provided in the form of a board, is first heated in a furnace such as a roller hearth furnace and then cooled and hardened in a press during the forming process. To set a (predominantly) martensitic structure here, for example, prior to the press hardening process, the steel sheet is first heated to a temperature above the AC1 temperature, the temperature at which the formation of austenite begins during an initial heating process, or even above the AC3 temperature, a temperature at which the conversion of ferrite to austenite ends during an initial heating process, and then shaped in the press hardening process and cooled accordingly (below the martensite start temperature).

The corresponding metal components are typically coated to improve the properties of the metal. For example, aluminum and silicon (AlSi) coatings are used in order to be able to dispense with a protective gas during the heat treatment process and to be able to dispense with surface post-treatment after the heat treatment, or also zinc coatings, which likewise improve the corrosion resistance. Rapid heating of the components is often desirable since this allows a short furnace length to be achieved in a roller hearth furnace and, on the other hand, there is more freedom in process planning with regard to the cycle times of the press following the heating.

However, due to the different thermal expansion behavior, a rapid heating up process can lead to increased component warpage, which complicates the transport of the component (on the conveyor line) or even leads to the formation of cracks in the component and/or in the coating, so that in the case of preliminarily coated components a rapid heating up process prior to press hardening has so far not been successful on the market. In addition, the coating can become detached from the metal component during transport through the furnace and thus cause contamination of the furnace.

The present invention is therefore based on the object of at least partially overcoming the disadvantages known from the prior art and, in particular, of specifying a method for heating metals and a corresponding roller hearth furnace which makes it possible to rapidly heat up coated components with at least reduced crack formation. Furthermore, a corresponding roller hearth furnace and a corresponding method for press hardening are to be specified.

These objects are achieved by the features of the independent claims. Further advantageous embodiments of the solution proposed here are specified in the dependent claims. It should be noted that the features listed individually in the dependent claims can be combined with each other in any technologically meaningful manner and define further embodiments of the invention. In addition, the features specified in the claims are described and explained in more detail in the description, further preferred embodiments of the invention being thereby shown.

The method according to the invention for heating a metal component to a target temperature, at which the component has a preliminary coating and is passed through a furnace which has at least four zones, each of which can be adjusted to an individual zone temperature, the component is successively passed through at least an initial heating zone, a plateau zone, a peak heating zone and an end zone, the initial heating zone being heated to an initial heating temperature, the plateau zone to a plateau temperature, the peak heating zone to a peak temperature and the end zone to a target temperature, the plateau temperature being chosen such that the temperature of the component in the plateau zone which lies in a band around a melting temperature of the preliminary coating is characterized in that the peak temperature is at least 100 K [kelvins], preferably at least 120 K, particularly preferably even at least 140 K, above the target temperature.

The metal component is preferably a metal board, a steel sheet or an at least partially preformed semi-finished product, preferably consisting of steel. The metal component is preferably made with or from a (hardenable) steel, for example a boron (manganese) steel, e.g. 22MnB5 steel. The preliminary coating may be, for example, a (predominantly) zinc-containing coating or a (predominantly) aluminum and/or silicon-containing coating, in particular a so-called aluminum/silicon (Al/Si) coating.

The temperature in the individual zones is achieved preferably (exclusively) by means of radiant heat, for example from at least one electrically operated (not physically and/or electrically contacting) heating means, such as for example a heating loop and/or a heating wire, and/or at least one (gas heated) jet pipe. The metal component is preferably heated in the individual zones by means of radiant heat and/or convection.

The individual zones are preferably defined solely by the temperature in the zone that can be set by appropriate heating means. In addition, the corresponding zones can also be structurally defined, for example by means of appropriate shielding means between the zones, at least reducing or preventing the convection between adjacent zones and/or the entry of radiant heat from one zone into an adjacent zone.

In the initial heating zone, the metal components that were previously usually at room temperature are heated (slowly). For this purpose, the initial heating temperature is preferably well below the target temperature. Also preferred is an embodiment in which the initial heating temperature is above the plateau temperature.

The band is understood to mean in particular a temperature range of +/−30 K, preferably +/−10 K, around the melting temperature of the preliminary coating. Liquefaction of the preliminary coating begins in this band. By keeping the temperature in the band, a (stable) oxide layer is formed on the liquefying preliminary coating during liquefaction, which can at least partially absorb the shear forces during transport of the metal component. Thus, adherence and penetration of the molten or melting preliminary coating to the rollers in this area of the furnace is substantially reduced or even avoided. The plateau temperature is usually well below the target temperature, in particular more than 300 K below the target temperature or even more than 350 K below the target temperature.

The peak temperature is preferably even 150 K above the target temperature. The (suddenly) significantly increased temperature after the plateau temperature causes the metal component to heat up rapidly. Compared to other methods in which large parts of the furnace are adjusted to the target temperature, heating up can be achieved much more rapidly. The fact that the plateau zone is formed before the peak heating zone effectively prevents the preliminary coating from shearing off.

This leads to a method in which the surface of the metal component is protected during transport through the furnace and, at the same time, it is possible to rapidly heat up the component.

The initial heating temperature, the plateau temperature, the peak temperature and/or the target temperature are predetermined based on the material of the metal component used, the type and/or thickness of the preliminary coating and/or the design, in particular the shape and/or thickness of the metal component. In the context of this document, the term "adjusting" basically means "heating."

By heating the component up faster than in known methods, it is also possible to make a furnace system shorter compared to furnace systems or methods known from the prior art.

According to an advantageous embodiment of the method, the preliminary coating is formed from a material comprising aluminum and silicon.

The metal coating may be, for example, a (predominantly) zinc-containing coating or a (predominantly) aluminum- and/or silicon-containing coating, in particular a so-called aluminum/silicon (Al/Si) coating. This coating serves in particular to protect the component from scaling during the heat treatment and prevents decarburization at the edge. Usual layer thicknesses are in the range between 10 and 50 μm [micrometers], preferably in the range of 20 and 40 μm.

The heating up method according to the present invention is particularly advantageous in the case of Al/Si coatings, since this preliminary coating is very brittle at room temperature, so that flaking and thus damage to the preliminary coating can occur rapidly if the heating up takes place too rapidly and the shear stress is too great during transport through the furnace. The method according to the invention permits to rapidly heat up metal components that are preliminarily coated with Al/Si.

Method according to one of the preceding claims, in which the peak heating zone directly adjoins the plateau zone.

The direct connection of the peak heating zone to the plateau zone allows the metal component to be heated up particularly rapidly.

According to a further advantageous embodiment of the method, at least one intermediate zone is formed between the plateau zone and the peak heating zone and is adjusted to an intermediate zone temperature between the temperature of the previous zone and the peak temperature.

This allows a more precise definition of the individual zones, since the heat input from the top heating zone into the plateau zone can then be reduced. This allows a more precise definition of the temperature in the plateau zone, so that the process of oxide formation on the preliminary coating can proceed more evenly. The intermediate heating zone in the direction of transport of the metal component through the furnace is preferably shorter than the peak heating zone, in particular it has a length which is less than half the length of the peak heating zone, preferably less than a quarter of the length of the peak heating zone.

According to a further embodiment of the invention, in the initial heating zone the component is passed over rollers which are made of quartz material.

Quartz material here means in particular a material comprising silicon dioxide ($SiO_2$). In the initial heating zone, the metal component, which is significantly cooler, usually essentially at ambient or room temperature, is introduced into the atmosphere of the furnace, which is significantly hotter, for example 500° C. or more. This leads to considerable loads on the rollers over which the component is passed due to thermal stresses. It has been shown that rollers made of quartz material are particularly well suited for the initial heating zone due to the low coefficient of thermal expansion. These rollers are very resistant to changes in temperature.

According to a further advantageous embodiment of the invention, the component is passed over rollers which are made of a mullitic ceramic material in at least one of the following zones:

a) the plateau zone;

b) the peak heating zone; and c) the end zone

Rollers made of mullitic-ceramic material are preferably used when the temperature of the atmosphere in the furnace rises, since these have a higher permissible application temperature than quartz material rollers. In addition, these rollers are significantly cheaper.

According to a further aspect of the present invention, a roller hearth furnace is proposed for heating a metal component having a preliminary coating to a target temperature, in particular according to a method according to one of the preceding claims, in which the component can be passed on rollers from an access through the roller hearth furnace to an exit, further comprising at least four heating means, by means of which an individual temperature can be set in a zone around the heating means, and a control means for individually controlling at least four of the heating means. The roller hearth furnace is characterized by the fact that the control means is suitable and intended for controlling the heating means in such a way that at least the following zones can be formed from the access to the exit in this order: an initial heating zone which can be adjusted to an initial heating temperature, a plateau zone which can be heated to a plateau temperature, a peak heating zone which can be adjusted to a peak temperature and an end zone which can be heated to a final temperature, the control means and the heating means being suitable and intended to set a plateau temperature which lies in a band around a melting temperature of the preliminary coating and to set a peak temperature which is at least 100 K above the target temperature.

Rollers made of quartz material are preferably arranged in the initial heating zone.

Rollers made of a ceramic material are preferably present in at least one of the following zones:

a) the plateau zone;

b) the peak heating zone; and c) the end zone

Shielding means are furthermore preferably formed between at least two adjacent zones.

The shielding means are preferably designed as internals between at least part of the individual zones, which narrow the furnace cross section in this area. This reduces the longitudinal flow between adjacent zones. In addition, the shielding means can prevent heat radiation from one zone to the other zone and thus enable a better definition of the temperature in the respective zones.

A press hardening device is regularly connected to the roller hearth furnace according to the invention. A temperature control unit can be arranged between the roller hearth furnace and the press-hardening device, which cools at least a partial area of the component in a targeted manner and at the same time keeps or increases the temperature in at least one further partial area of the component, so as to set a different strength in at least one partial area.

Furthermore, a method for press hardening a metal component is proposed, in which a metal component heated to the target temperature according to the present invention is subjected to press hardening in a press hardening device.

In this context, it is preferred that the metal component is fed between the heating and the press hardening to at least one temperature control unit in which the temperature of at least a partial area of the metal component is changed.

The details and advantages disclosed for the method according to the invention can be transferred and applied to the roller hearth furnace according to the invention and vice versa.

Figure 2:
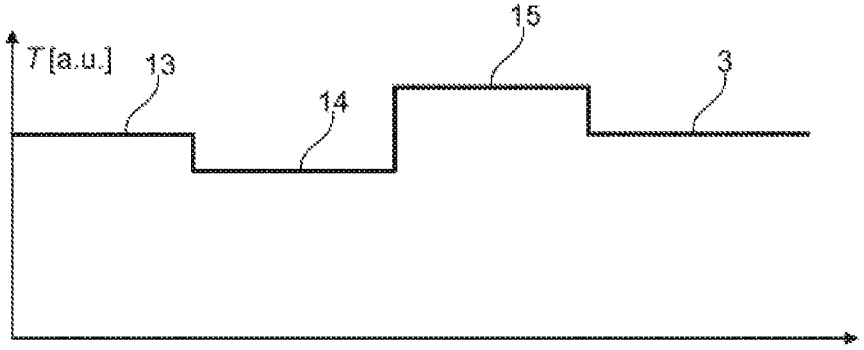
Figure 3:
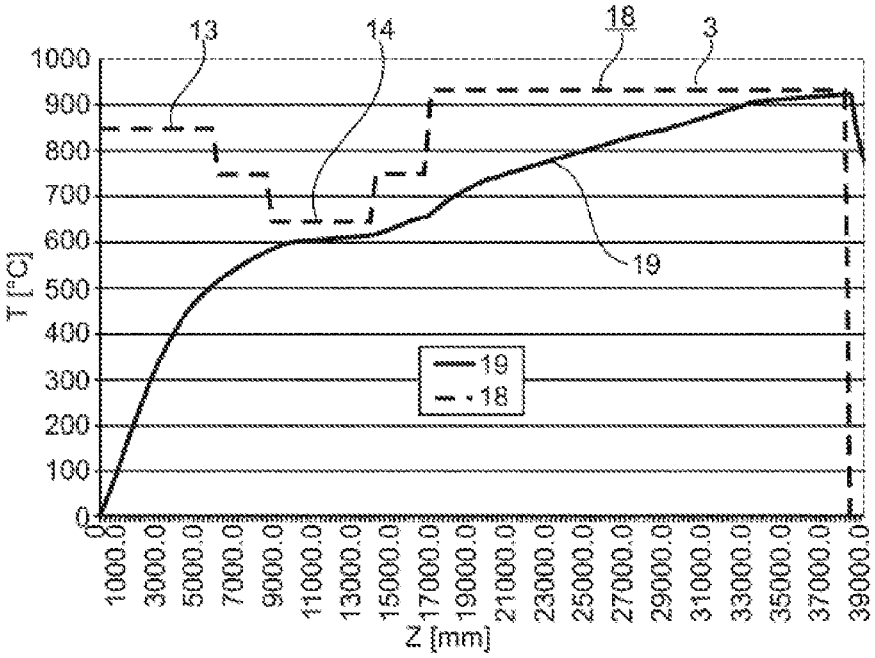
Figure 4:
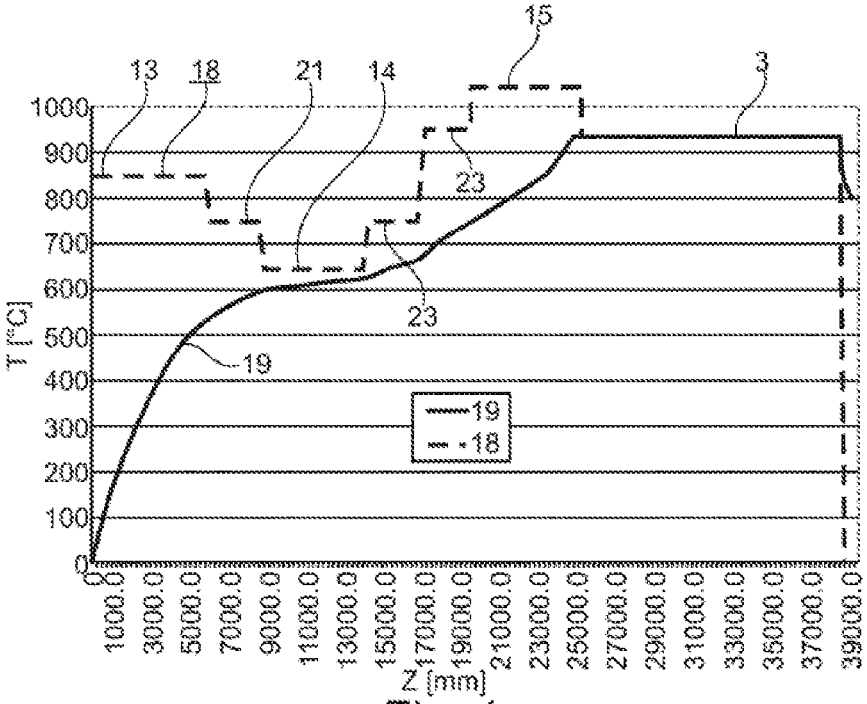
Figure 5:
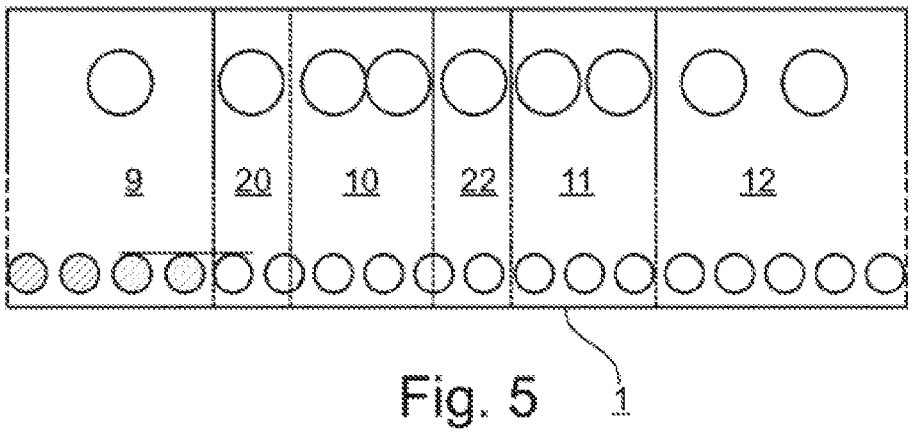
Figure 6:
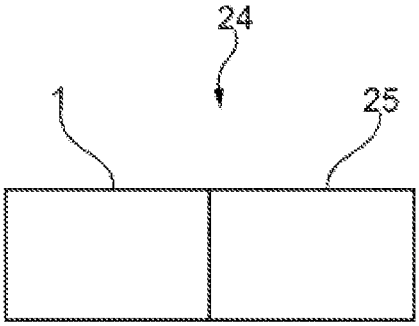
Figure 7:
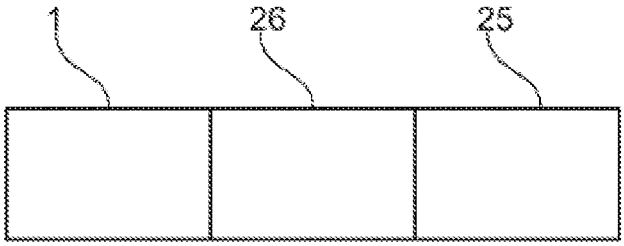

The invention and the technical environment will be explained in more detail with reference to the figures. It should be noted that the invention should not be limited by the exemplary embodiments shown. In particular, unless explicitly stated otherwise, it is also possible to extract partial aspects from the facts explained in the figures and to combine them with other components and/or insights from other figures and/or from the present description. They show schematically:

FIG. 1 a roller hearth furnace which is operated according to the inventive method;

FIG. 2 a temperature control in the roller hearth furnace;

FIG. 3 an example of a temperature control assumed to be known;

FIG. 4 an example of a temperature control according to the present invention;

FIG. 5 another example of a roller hearth furnace;

FIG. 6 a first example of a device for the heat treatment of components; and FIG. 7 a second example of a device for the heat treatment of components.

FIG. 1 schematically shows a roller hearth furnace 1, in which a method for heating a metal component 2 to a target temperature 3 is carried out. The corresponding temperatures are shown schematically in FIG. 2. For this purpose, the metal component 2 is passed through an access 4 into the roller hearth furnace 1. In the roller hearth furnace 1, the metal component 2 is passed over rollers 5 through the roller hearth furnace 1 to the exit 6.

In the present case, the metal component 2 has an Al/Si preliminary coating 7, which is flat and formed mostly on both sides of the metal component 2. In the direction of movement 8 of the metal component 2, an initial heating zone 9, a plateau zone 10, a peak heating zone 11 and an end zone 12 adjoin the access 4. In operation, the initial heating zone 9 is adjusted to an initial heating temperature 13, the plateau zone 10 is adjusted to the plateau temperature 14, the peak heating zone 11 is adjusted to a peak temperature 15 and the end zone 12 is adjusted to the target temperature 3 (heated). For this purpose, heating means 16 are formed, which are designed here as jet pipes. The individual jet pipes each include gas burners that burn into a closed (ceramic) pipe, so that the combustion exhaust gases are not introduced into the furnace in order to prevent the hydrogen embrittlement of the metal, which may be promoted by the exhaust gases of the combustion, in particular of moist exhaust gas.

The number and design of the individual heating means 16 are shown as examples. This means that in each zone 9, 10, 11, 12 a different number of heating means 16, each heating means 16 of different strengths and/or in each case different heating means 16, such as partially electric heating means 16 and partially jet pipes, can be designed as heating means 16. The same also applies to the rollers 5, which can be formed in different numbers and/or at different intervals and/or from different materials in each zone 9, 10, 11, 12. To carry out the method, the heating means 16 are connected to a control means 17, by means of which the operation of the heating means 16 can be controlled or regulated and which is suitable and intended for the corresponding activation of the heating means 16. In addition, at least individual (driven) rollers 5 can also be connected to the control means 17.

Shielding means 27 are formed between zones 9, 10, 11, 12, which in particular reduce or prevent a longitudinal flow between adjacent zones 9, 10, 11, 12. As an alternative or in addition, the shielding means 27 can be designed in such a way that they reduce or prevent thermal radiation between adjacent zones 9, 10, 11, 12. The shielding means 27 are formed in the present example as internals reducing the open cross section of the roller hearth furnace 1, the height of which can vary.

In the present example, the rollers 5 in the initial heating zone 9 are made of a quartz material, while the rollers in the plateau zone 10, the peak heating zone 11 and the end zone 12 are made of a ceramic material. The rollers 5 in the initial heating zone 9 are preferably made of quartz material in order to be able to absorb the thermal loads on the rollers 5 due to the large temperature difference between the (hot) rollers 5 and the (cold) metal component 2.

The heating means 16 are regulated, for example, in such a way that, for a component made of a boron manganese steel marketed as "Usibor® 1500" or "MBW® 1500+AS" and which has an Al/Si preliminary coating 7, in the initial heating zone 9 as the initial heating temperature 13 a temperature of approximately 840 to 860° C., in particular of 850° C. is set, in the plateau zone 10 as plateau temperature 14 a temperature of approximately 630° C. to 670° C., in particular of 650° C. is set with a band of +/−20° C. around the melting temperature of the preliminary coating 7, in the peak heating zone 11 as the peak temperature a temperature of about 1080 to 1120° C., in particular 1100° C. is set, and in the end zone 12 as the target temperature 3 a temperature of 870 to 940° C. is set.

FIG. 3 shows, in contrast, a temperature profile assumed to be known, in which the zone temperature 18 and the component temperature 19 are shown. Several zones are also formed here. The (cold) metal component 2 first crosses an initial heating zone with an initial heating zone temperature 13, then a plateau zone with a plateau temperature 14 and then an end zone with a target temperature 3. Accordingly, the component temperature 19 follows a curve from a start temperature to the target temperature 3.

FIG. 4 shows an example of a temperature profile with zone temperature 18 and component temperature 19 according to the method proposed here. In addition to the initial heating zone temperature 13, plateau temperature 14 and target temperature 3, the zone temperature here also shows the peak heating zone 11. Comparing the component temperature 19 in this example with the component temperature 19 as shown in FIG. 3, the component temperature 19 reaches the target temperature 3 faster in the method proposed here than in the method assumed to be known, as shown in FIG. 3.

FIGS. 4 and 5, which show a further embodiment of a roller hearth furnace 1, further show the formation of intermediate zones. A first intermediate zone 20 is formed between the initial heating zone 9 and the plateau zone 10, the first intermediate zone temperature 21 of which lies between the initial heating temperature 13 and the plateau temperature 14. The first intermediate zone 20 reduces or prevents heat exchange between the initial heating zone 9 and the plateau zone 10, so that a more precise control of the furnace temperature in the zones 9, 10 is possible. Furthermore, the zone temperature 18 in FIG. 4 shows two second intermediate zones 22 between the plateau zone 10 and the peak heating zone 11, which have two second intermediate zone temperatures 23. These serve to define the peak heating zone 11 and the plateau zone 10 more precisely. For the rest, reference is made to the above description of FIG. 1.

FIG. 6 shows a device 24 for heat treatment of a metal component 2 with a roller hearth furnace 1 and a press hardening unit 25.

For example, it is possible to select the target temperature 3 in the roller hearth furnace 1 so that it is at or above the AC1 temperature (i.e. the temperature at which the formation of austenite begins during a heating process), or even above the AC3 temperature (the temperature at which the conversion of ferrite to austenite ends during a heating process) of the corresponding material of the metal component 2, that at least a proportion of martensite is formed in the metal component during the subsequent press hardening.

Optionally, at least one temperature control unit 26 is formed between the roller hearth furnace 1 and the press hardening unit 25 (see FIG. 7), which, after the metal component 2 has rapidly been heated up in the roller hearth furnace 1, allows the temperature of areas of the metal component 2 to be adjusted differently, in particular to heat partial areas and to cool other parts.

Alternatively, a method can be chosen in which the target temperature 3 is chosen so that it is below the AC3 or even AC1 temperature and then in a subsequent temperature control unit 26 in at least a partial area of the metal component 2 the temperature is increased above the AC1 or AC3 temperature, while the temperature in at least one other partial area of the metal component 2 is left below the AC1 or AC3 temperature. In this way, metal components 2 can be produced which, after press hardening, have areas of different structures or strengths.

LIST OF REFERENCE NUMBERS

1 roller hearth furnace
2 metal component
3 target temperature
4 access
5 roller
6 exit
7 preliminary coating
8 direction of movement
9 initial heating zone
10 plateau zone
11 peak heating zone
12 end zone
13 initial heating temperature
14 plateau temperature
15 peak temperature
16 heating means
17 control means
18 zone temperature
19 component temperature
20 first intermediate zone
21 first intermediate zone temperature
22 second intermediate zone
23 second intermediate zone temperatures
24 heat treatment device
25 press hardening unit
26 adjusting station
27 shielding means

The invention claimed is:

1. A method comprising heating a metal component to a target temperature, in which the component has a preliminary coating and is passed through a furnace that has at least four zones, which can be respectively adjusted to an individual zone temperature, wherein the component is passed successively through at least an initial heating zone, a plateau zone, a peak heating zone and an end zone and wherein the initial heating zone is adjusted to an initial heating temperature, the plateau zone is adjusted to a plateau temperature, the peak heating zone is adjusted to a peak temperature and the end zone is adjusted to the target temperature, the plateau temperature being chosen such that the temperature of the component in the plateau zone lies in a band around a melting temperature of the preliminary coating which is characterized in that the peak temperature lies at least 100 K above the target temperature, the method further comprising forming a first intermediate zone between the initial heating zone and the plateau zone, a first intermediate zone temperature of which lying between the initial heating temperature and the plateau temperature, and forming at least one second intermediate zone between the plateau zone and the peak heating zone, the at least one second intermediate zone having a second intermediate zone temperature, which is between the plateau temperature and the peak temperature.

2. The method of claim 1, wherein the preliminary coating is formed from a material comprising aluminum and silicon.

3. The method according to claim 2, wherein the component in the initial heating zone is passed over rollers which are made of quartz material.

4. The method according to claim 2, in which the component is passed over rollers which are formed from a ceramic material in at least one of the following zones: a) the plateau zone; b) the peak heating zone; and c) the end zone.

5. The method according to claim 1, wherein the component in the initial heating zone is passed over rollers which are made of quartz material.

6. The method according to claim 1, in which the component is passed over rollers which are formed from a ceramic material in at least one of the following zones: a) the plateau zone; b) the peak heating zone; and c) the end zone.

7. The method of claim 1 further comprising press hardening the metal component in a press hardening device, after the metal component has been heated to the target temperature.

8. The method according to claim 7, wherein the metal component between the heating and the press hardening is supplied to at least one temperature control unit in which the temperature of at least a portion of the metal component is changed.

9. A roller hearth furnace for heating a metal component having a preliminary coating to a target temperature in which the component can be passed on rollers from an access through the roller hearth furnace to an exit, further comprising at least four heating means through which an individual temperature in a zone around the heating means is adjustable, and a control means for individually controlling at least four of the heating means, wherein the control means is suitable and intended in a manner for controlling the heating means and is determined that at least the following zones can be formed from the access to the exit in this order: an initial heating zone which can be adjusted to an initial heating temperature, a first intermediate zone, a plateau zone which can be adjusted to a plateau temperature, a second intermediate zone, a heatable peak heating zone which can be adjusted to a peak temperature, and an end zone which can be adjusted to the target temperature, wherein the first intermediate zone is between the initial heating zone and the plateau zone and which can be adjusted to a first intermediate zone temperature which is between the initial heating temperature and the plateau temperature, wherein the second intermediate zone is between the plateau zone and the heatable peak heating zone and which can be adjusted to a second intermediate zone temperature which is between the plateau temperature and the peak temperature, the control means and the heating means being suitable for setting the plateau temperature to be in a band around a melting temperature of the preliminary coating and setting the peak temperature to be at least 100 K above the target temperature.

10. The roller hearth furnace according to claim 9, in which in the initial heating zone rollers made of quartz material are configured.

11. The roller hearth furnace according to claim 9, in which rollers are formed from a ceramic material in at least one of the following zones: a. the plateau zone; b. the peak heating zone; and c. the end zone.

12. The roller hearth furnace according to claim 9, in which shielding means are formed between at least two adjacent zones.

* * * * *